US009255673B2

(12) United States Patent
Horn et al.

(10) Patent No.: US 9,255,673 B2
(45) Date of Patent: Feb. 9, 2016

(54) LED BULB HAVING AN ADJUSTABLE LIGHT-DISTRIBUTION PROFILE

(71) Applicant: Switch Bulb Company, Inc., San Jose, CA (US)

(72) Inventors: David Horn, Saratoga, CA (US); Matrika Bhattarai, San Jose, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 14/142,664

(22) Filed: Dec. 27, 2013

(65) Prior Publication Data

US 2015/0184815 A1 Jul. 2, 2015

(51) Int. Cl.

| | |
|---|---|
| ***F21K 99/00*** | (2010.01) |
| ***F21V 7/20*** | (2006.01) |
| ***F21V 29/00*** | (2015.01) |
| ***H01J 7/26*** | (2006.01) |

(52) U.S. Cl.

CPC ..... *F21K 9/58* (2013.01); *F21K 9/1375* (2013.01); *F21K 9/54* (2013.01); *F21K 99/00* (2013.01); *F21V 7/20* (2013.01); *F21V 29/00* (2013.01); *F21V 29/30* (2013.01)

(58) Field of Classification Search

None

See application file for complete search history.

(56) References Cited

U.S. PATENT DOCUMENTS

| | | | | |
|---|---|---|---|---|
| 3,648,045 | A | 3/1972 | Le Vantine et al. | |
| 5,228,770 | A | 7/1993 | Brunson | |
| 6,132,072 | A | 10/2000 | Turnbull et al. | |
| 6,601,970 | B2 | 8/2003 | Ueda et al. | |
| 7,461,960 | B2 | 12/2008 | Opolka et al. | |
| 8,210,709 | B2 | 7/2012 | Maglica | |
| 8,371,729 | B2 | 2/2013 | Sharrah et al. | |
| 8,390,207 | B2 | 3/2013 | Dowling et al. | |
| 8,398,271 | B2 | 3/2013 | Chan | |
| 8,403,530 | B2 | 3/2013 | Singer et al. | |
| 8,449,136 | B2 | 5/2013 | Palmer et al. | |
| 2006/0039139 | A1 | 2/2006 | Maglica et al. | |
| 2010/0109038 | A1 | 5/2010 | Moore et al. | |
| 2011/0121727 | A1* | 5/2011 | Sharrah et al. | 315/32 |
| 2011/0170289 | A1* | 7/2011 | Allen et al. | 362/235 |
| 2012/0002435 | A1* | 1/2012 | Van Gorkom et al. | 362/551 |
| 2012/0287653 | A1* | 11/2012 | Chen et al. | 362/430 |
| 2013/0113358 | A1* | 5/2013 | Progl et al. | 313/46 |
| 2014/0300267 | A1* | 10/2014 | Oh et al. | 313/46 |

FOREIGN PATENT DOCUMENTS

| | | | |
|---|---|---|---|
| FR | 2919397 | A1 | 1/2009 |

OTHER PUBLICATIONS

"LED Lamps", retrieved on Jun. 21, 2013 available online at < http://www.bulbtronics.com/LED-Lighting/LED-Lamps.aspx?AspxAutoDetectCookieSupport=1 >, 1 page.

* cited by examiner

*Primary Examiner* — Ashok Patel

(74) *Attorney, Agent, or Firm* — Morrison & Foerster LLP

(57) ABSTRACT

A light-emitting diode (LED) bulb includes a reflector, a plurality of LEDs disposed within a recess of the reflector, a thermally conductive liquid disposed within the recess, and an adjustment mechanism to move the LEDs from a first position to a second position, with respect to the reflector. The thermally conductive liquid may transfer heat generated by the LEDs to the reflector, and the reflector may dissipate heat transferred by the thermally conductive liquid to the surrounding environment. The reflector may also reflect light from the LEDs to produce a first light-distribution profile, having a respective first beam angle, when the LEDs are in the first position, and to produce a second light-distribution profile, having a respective second beam angle, when the LEDs are in the second position.

27 Claims, 8 Drawing Sheets

LED BULB HAVING AN ADJUSTABLE LIGHT-DISTRIBUTION PROFILE

BACKGROUND

1. Field

The present disclosure relates generally to light-emitting diode (LED) bulbs and, more specifically, to an LED bulb having an adjustable light-distribution profile.

2. Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb—for example, 10,000-100,000 hours as opposed to 1,000-2,000 hours.

Although LEDs provide advantages in efficiency and lifetime, they also present various design challenges related to heat dissipation and light distribution. LEDs are about 80% efficient, meaning that 20% of power supplied to LEDs is lost as heat. In many cases, an LED bulb is operated so that the heat produced is below an acceptable threshold level. Preventing an LED from reaching excessive temperatures may maximize the lifetime of the LED and also maximize the overall light output. The operating temperature of LEDs in an LED bulb depends on multiple factors, including the number of LEDs, the type of LEDs, and the thermal properties of the bulb. Traditionally, the heat from the LEDs is conducted through an LED mount to a base of the bulb, where it is dissipated to the surrounding environment.

Another challenge associated with LED bulbs is that the light distribution of the LEDs tends to be highly dependent on direction. That is, in at least some cases, an LED emits significantly more light in certain directions than it does in others. Thus, the placement and orientation of the LEDs in an LED bulb have a significant impact on the light-distribution profile of the device. If the placement of the LEDs is adjustable (as described in some embodiments below), additional difficulties may arise when dissipating heat through the base of the bulb, as done in some traditional LED bulbs.

Thus, there is a need for an LED bulb that allows for adjustable placement of the LED while also dissipating a sufficient amount of heat to ensure reliable operation of the LEDs.

SUMMARY

In one exemplary embodiment, an LED bulb is provided with a reflector having a recess and a reflective inner surface, a plurality of LEDs disposed within the recess, a thermally conductive liquid within the recess and in thermal contact with both the LEDs and the inner surface of the reflector, and an adjustment mechanism configured to move the plurality of LEDs from a first position to a second position, with respect to the reflector. The thermally conductive liquid may be configured to transfer heat generated by the LEDs to the reflector, and the reflector may be configured to dissipate heat transferred by the thermally conductive liquid to the surrounding environment. The reflector may also be configured to reflect light from the LEDs to produce a first light-distribution profile when the LEDs are in the first position, and to produce a second light-distribution profile when the LEDs are in the second position. The first and second light-distribution profiles may be characterized by first and second beam angles, respectively.

In some embodiments, the adjustment mechanism is configured to move the LEDs and/or the reflector parallel to a longitudinal axis of the reflector, and in some embodiments, the adjustment mechanism is configured to move the LEDs in a radial direction relative to the longitudinal axis of the reflector. The LEDs may face radially outward from the longitudinal axis of the reflector and/or be arranged in a radial pattern. In some embodiments, the reflector is a paraboloid, such as a parabolic aluminized reflector. In some embodiments, the LED bulb includes a volume compensation mechanism such as, for example, a bladder or a diaphragm configured to compensate for expansion of the thermally conductive liquid.

In another exemplary embodiment, an LED bulb is provided with a reflector having a plurality of sub-reflectors arranged around the longitudinal axis of the reflector. Each of the sub-reflectors may be, for example, a portion of a parabolic reflector. The optical axis of each of the sub-reflectors may be substantially parallel to and offset from the longitudinal axis of the reflector. A plurality of LEDs may be disposed within a recess in the reflector such that each LED is located proximate to an optical axis of one of the sub-reflectors. The LED bulb may also include a thermally conductive liquid within the recess and in thermal contact with the LEDs and an inner surface of the reflector. The thermally conductive liquid may be configured to transfer heat generated by the LEDs to the reflector, and the reflector may be configured to dissipate heat transferred by the thermally conductive liquid to the surrounding environment. The LED bulb may include an adjustment mechanism configured to move the plurality of LEDs from a first position with respect to the reflector to a second position with respect to the reflector. The reflector may be configured to reflect light from the LEDs to produce a first light-distribution profile when the LEDs are in the first position, and to produce a second light-distribution profile when the LEDs are in the second position. The first and second light-distribution profiles may be characterized by first and second beam angles, respectively.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below, relating to an LED bulb configured to produce an adjustable light distribution. As used herein, an "LED bulb" refers to any light-generating device (e.g., a lamp) in which at least one LED is used to generate the light. An LED is typically a doped semiconducting substrate with a p-n junction thereon that, when electrically stimulated, emits energy in the form of photons. The wavelength of the light output caused by the release of these photons depends on the band gap of the p-n junction of the LED. Each LED may additionally have integrated optical components for shaping the light output. Thus, as used herein, an "LED bulb" does not include a light-generating device in which a filament is used to generate the light, such as a conventional incandescent light bulb or lamp.

In some embodiments, the LED bulb may use 6 W or more of electrical power to produce light equivalent to a 40 W incandescent bulb. In some embodiments, the LED bulb may use 18 W or more to produce light equivalent to or greater than a 100 W incandescent bulb. Depending on the efficiency of the LED bulb, between 4 W and 16 W of heat energy may be produced when the LED bulb is illuminated.

As discussed above, LEDs provide advantages in efficiency and lifetime, but also present challenges related to light distribution and heat dissipation. Unlike the light produced by a filament in an incandescent bulb, the light generated by an LED may be highly directional in that it emits significantly more light in certain directions than it does in others. And even if multiple LEDs are used to emit light over a greater range of directions, the resulting combined light distribution may still exhibit peaks due to the directional nature of the individual LEDs.

Figure 1A:
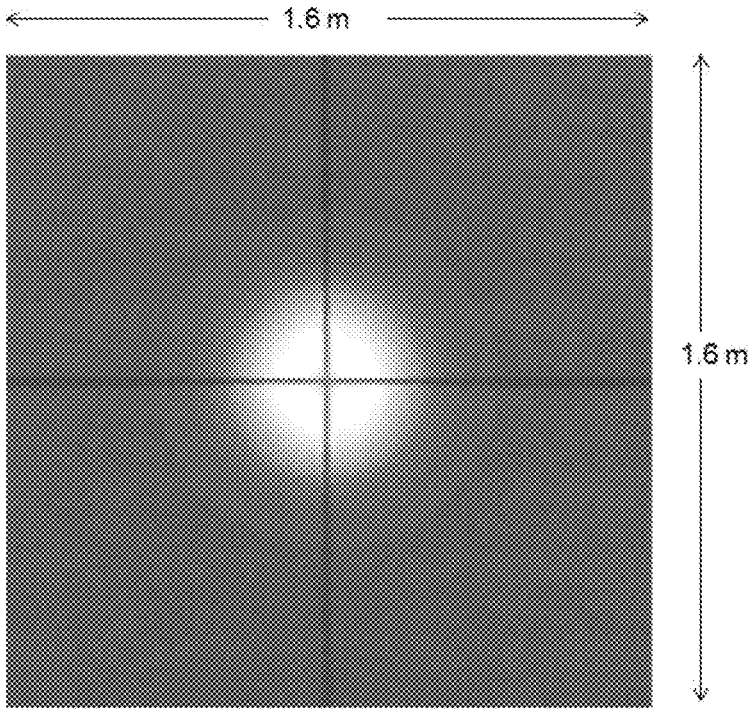
FIG. 1A depicts an exemplary light-distribution profile of an LED bulb at a distance of 0.5 m from the bulb on a 1.6 m by 1.6 m plane.
Figure 1B:
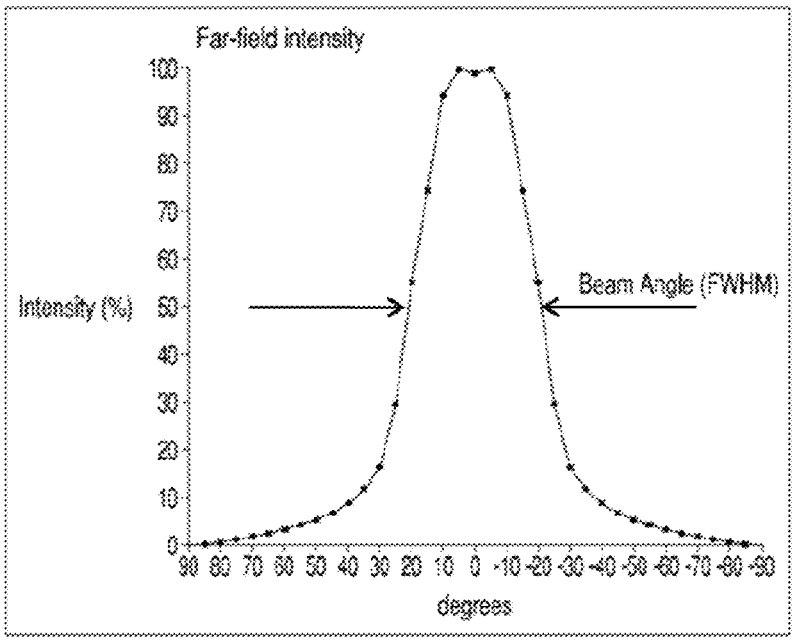
FIG. 1B depicts the far-field relative intensity of a cross-section of an exemplary light-distribution profile.

In some cases, it may be beneficial to produce a focused beam of LED light that has a smooth light-distribution profile over a desired beam angle. FIG. 1A shows an illuminance plot of an exemplary light-distribution profile of a focused beam of LED light from an LED bulb at a distance of 0.5 m from the LED bulb. FIG. 1B illustrates the relative intensity of a cross-section of the exemplary light-distribution profile shown in FIG. 1A. FIG. 1B indicates the angular extent of the full width of the profile at half of its maximum intensity, referred to as the beam angle at full-width-half-maximum (FWHM).

In addition, it may be desirable to be able to adjust the beam width of the light-distribution profile produced by an LED bulb. However, it is possible that the mechanism used to adjust the light-distribution may interfere with traditional thermal management techniques that include conducting heat from the LEDs to the base of the bulb, where it can be dissipated to the environment.

The embodiments discussed below are directed to an LED bulb having an adjustable light-distribution profile that also dissipates a sufficient amount of heat to ensure reliable operation of the LEDs. The beam angle of the light produced by the LED bulb is adjusted by changing the position of a plurality of LEDs within the recess of a concave reflector. The LED bulb also includes a thermally conductive liquid to transfer heat from the LEDs to the reflector. The reflector serves two purposes—it reflects light from the LEDs to form the output beam and also serves as a thermal conduit to dissipate heat produced by the LEDs from the thermally conductive liquid to the surrounding environment. Thus, the solutions presented in this disclosure address both the light-distribution issues and the thermal-management issues associated with LED bulbs.

Figure 2:
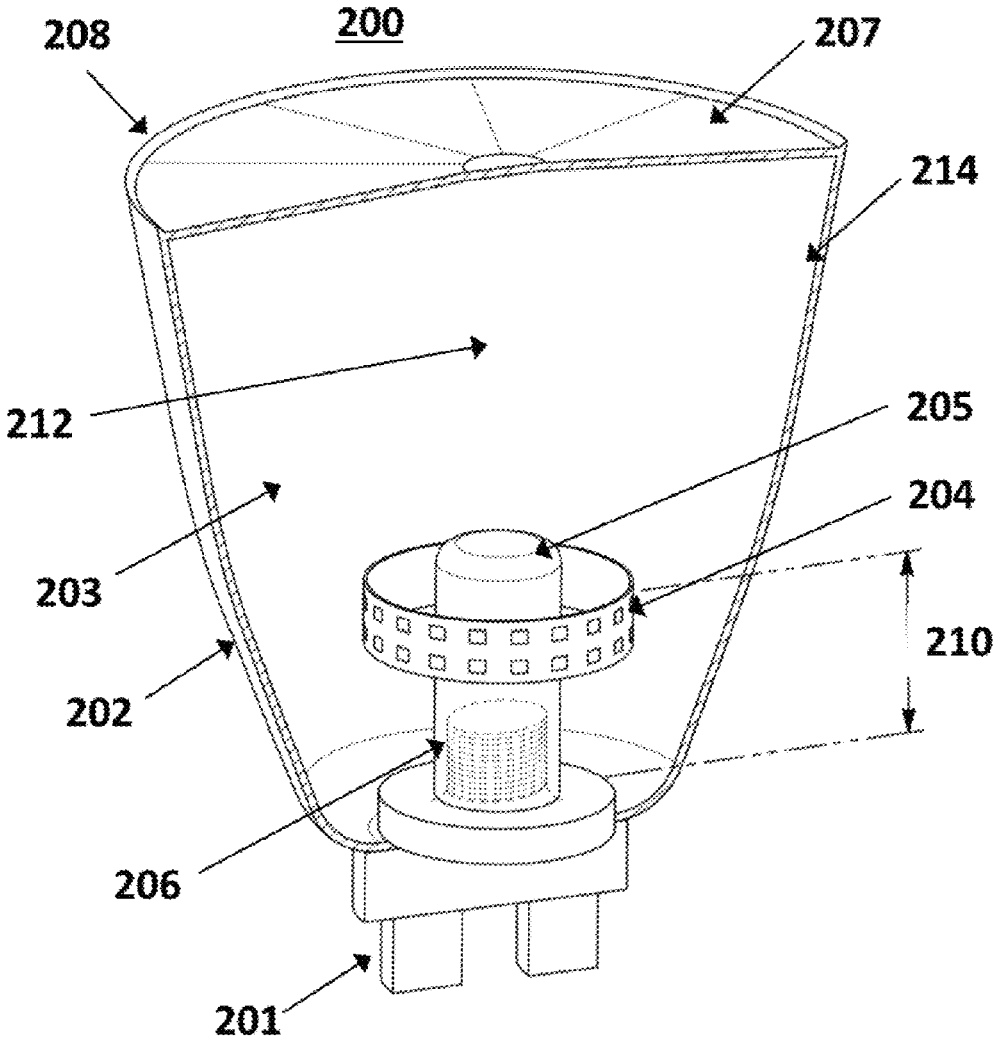
FIG. 2 depicts a cross-sectional view of an LED bulb.

FIG. 2 depicts an exemplary LED bulb 200 with an adjustable light-distribution profile. LED bulb 200 includes a reflector 202 having a recess 212 and an aperture 208. The reflector 202 is attached to a base 201 opposite the aperture 208. A plurality of LEDs 204 are connected to a mount 205 disposed within the recess 212. The mount 205 includes a post extending from the valley of the recess 212 toward the aperture 208 along the longitudinal axis of the bulb, and a ring portion surrounding the post. The LEDs 204 are arranged in an array with two rows of LEDs in a circular pattern around the ring of the mount 205 and positioned at an average distance 210 above the base 201. The LEDs 204 in the bulb illustrated in FIG. 2 face radially outward from the longitudinal axis of the bulb such that light generated by the LEDs 204 propagates toward an inner surface 214 of the reflector 202. The inner surface 214 of the reflector 202 is made of a material that reflects the light generated by the LEDs 204. Light from the LEDs incident on the reflective inner surface of the reflector is redirected generally toward the aperture 208, where it exits the LED bulb to produce a focused beam.

As depicted in FIG. 2, LED bulb 200 also includes an adjustment mechanism 206, which is connected to the mount 205. The adjustment mechanism 206 depicted in FIG. 2 is configured to move the mount 205 along the longitudinal axis of the LED bulb 200, which in turn moves the LEDs 204 substantially parallel to the longitudinal axis of the LED bulb 200. The adjustment mechanism 206 includes a threaded bolt that extends into a threaded interface in the bottom of the mount 205. The adjustment mechanism 206 functions in a manner similar to that of a lead screw, and the mount 205 functions as a nut to produce a linear actuator mechanism. When the adjustment mechanism 206 is caused to rotate, due to application of torque (e.g., when a user twists a control or a motor turns), the mount 205, along with the plurality of LEDs 204, moves along the longitudinal axis of the LED bulb 200, either toward or away from the base 201, depending on the direction of the rotation. Adjusting the position of the LEDs 204 causes the distribution of light output from the LED bulb 200 to change by altering the directions in which light from the LEDs 204 reflects off of the inner surface of the reflector. The way in which changing the position of the LEDs within a concave reflector operates to adjust the light-distribution will be described in greater detail below.

In addition, a transparent cover 207 is attached to the aperture 208 of reflector 202 to form an enclosed volume with recess 212. A thermally conductive liquid 203 fills the enclosed volume and is in thermal contact with the LEDs 204 and the inner surface 214 of the reflector 202. The thermally conductive liquid 203 removes heat from the LEDs 204 by thermal conduction and transfers the heat from the LEDs 204 to the reflector 202. The reflector 202 serves as a thermal conduit that is configured to dissipate heat from the thermally conductive liquid 203 to the surrounding environment and/or other portions of the LED bulb 200.

Thus, the reflector 202 serves as a dual-purpose element: (1) it is a reflective element in the optical path of the light generated by the LEDs 204 that directs light from the LEDs 204 to produce the output beam of the LED bulb 200, and (2) it is a conduit in the thermal path of the heat generated by the LEDs 204 in order to transfer heat from the thermally conductive liquid 203 to the surrounding environment and/or other portions of the LED bulb 200.

Figure 3A:
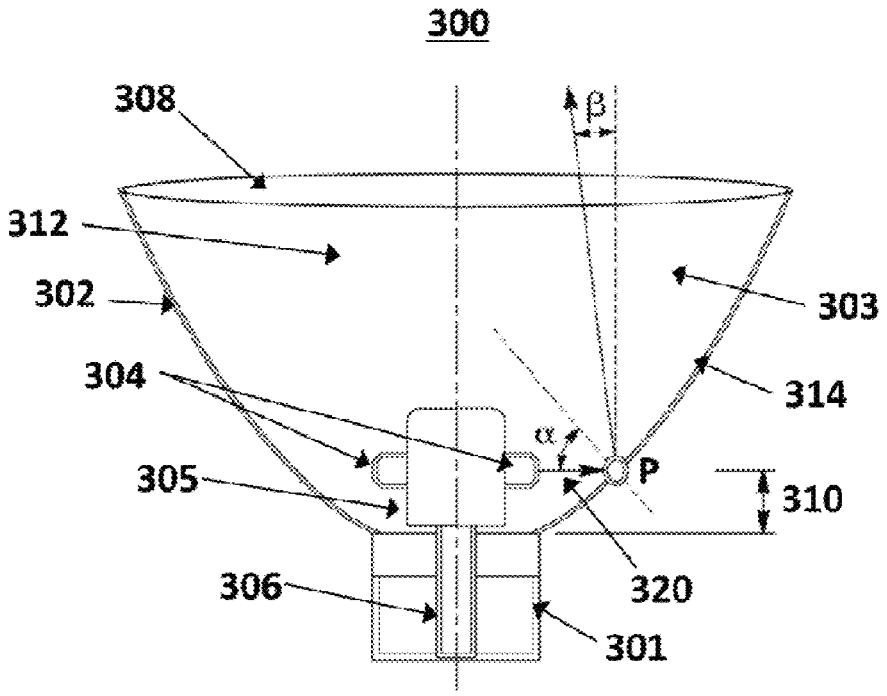
FIG. 3A depicts a cross-sectional view of an exemplary LED bulb having an LED mount in a first position and producing a first light-distribution profile.
Figure 3B:
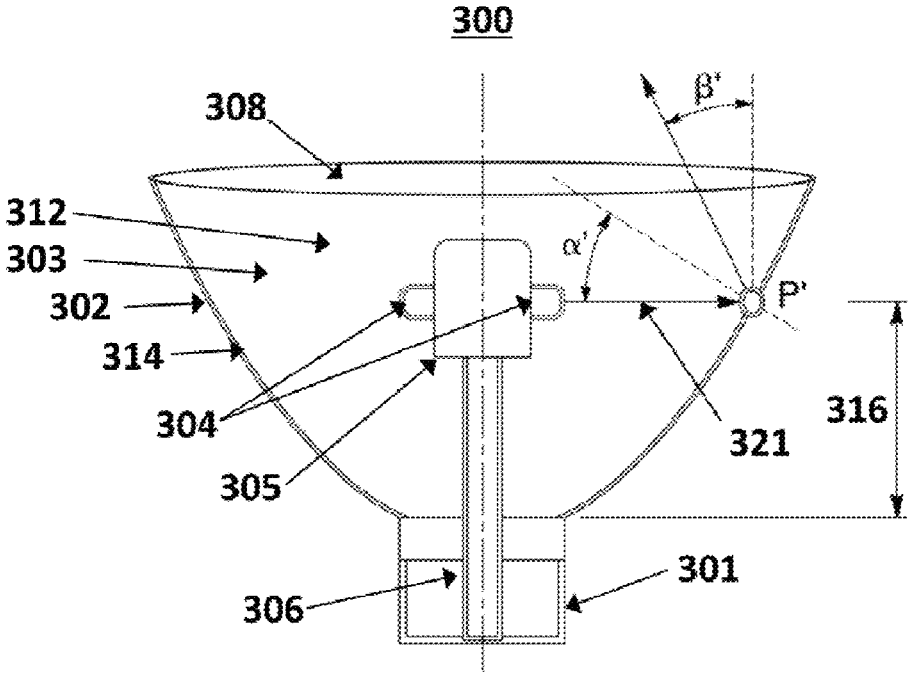
FIG. 3B depicts a cross-sectional view of an exemplary LED bulb having an LED mount in a second position and producing a second light-distribution profile.

Turning to FIGS. 3A and 3B, the optical path of light generated by LEDs disposed within the recess of a reflector will be described in greater detail. FIGS. 3A and 3B illustrate the principle by which the light-distribution profile of an LED bulb may be adjusted by changing the position of the LEDs relative to the reflector.

FIGS. 3A and 3B depict another embodiment of an LED bulb 300 including a plurality of LEDs 304 disposed within a recess 312 of a reflector 302. LED bulb 300 may also include a thermally conductive liquid 303 within the recess 312 to transfer heat from the LEDs 304 to the reflector 302. As explained below, the LED bulb 300 produces a first light-distribution profile when the LEDs 304 are located in a first position depicted in FIG. 3A, and produces a second light-distribution profile when the LEDs 304 are located in a second position depicted in FIG. 3B.

FIG. 3A depicts the LED bulb 300 with a mount 305 located in a first position and the LEDs 304 positioned a distance 310 from the base 301. The LEDs 304 are attached to the side of the mount 305 and face radially outward toward the inner surface 314 of the reflector 302 such that light emitted from the LEDs 304 propagates toward the reflector 302.

Propagation of the light emitted from the LEDs 304 is approximated by the path of rays traveling perpendicular to the wavefront of the emitted light. As shown in FIG. 3A, rays strike the reflective inner surface 314 of the reflector 302 at an angle of incidence, which is defined as the angle between the incident ray and the line normal to the surface at the point of incidence.

For example, ray 320 shown in FIG. 3A represents a ray of light emitted from an LED 304. The ray 320 travels away from the LED 304, striking the reflector 302 at a point P with an angle of incidence a relative to the surface normal. The ray 320 is reflected at an angle equal to the angle of incidence relative to the surface normal. As shown in FIG. 3A, the reflected ray 320 is directed toward the aperture 308 at an angle θ relative to the longitudinal axis of the LED bulb 300.

By comparison with FIG. 3A, FIG. 3B illustrates how changing the position of the LEDs 304 may adjust the light-distribution profile produced by the LED bulb 300. In the embodiment depicted in FIG. 3B, the adjustment mechanism 306 is used to move the mount 305 along the longitudinal axis of the LED bulb 300. Adjusting the mount 305 moves the LEDs 304 substantially parallel to the longitudinal axis of the LED bulb 300, and changes the position of the LEDs 304. FIG. 3B depicts the adjustment mechanism 306 in an extended configuration, placing the mount 305 in a second position, with the LEDs 304 located a distance 316 from the base 301.

Changing the position of the LEDs 304 alters the locations at which the rays emitted by the LEDs 304 strike the inner surface 314 of reflector 302, which changes the angles of incidence due to the curvature of the reflector's inner surface. For example, as shown in FIG. 3B, ray 321 travels away from the LED 304 in the same direction as ray 320 in FIG. 3A, except ray 321 is located at a greater distance 316 from the base 301. Ray 321 strikes the reflector 302 at point P' with an incident angle α' relative to the surface normal. Angle α' is different from angle α in FIG. 3A because the direction of the surface normal at point P' is not the same as for point P. Thus, the ray 321 is reflected at a different angle β relative to the longitudinal axis of the LED bulb 300. Accordingly, the ray 321 exits the LED bulb 300 in a different direction from ray 320 shown in FIG. 3A, resulting in a different light output.

In general, FIGS. 3A and 3B illustrate that the location of the LEDs 304 relative to the reflector 302 affects the position and angle of incidence at which the rays strike the reflector 302, which in turn determines the direction in which the rays exit the LED bulb 300. FIGS. 3A-3B depict the path of only one exemplary ray (320, 321) from a single LED 304 in a single direction in order to explain the basic optical operation of the LED bulb 300. However, LEDs 304 emit light over a range of angles. For example, the LEDs 304 may have an approximately Lambertian emission profile with a peak light intensity at an angle approximately perpendicular to the face of the LED, and less light emitted as the angle from the face of the LED is increased. The light rays emitted in each direction are reflected based on the angle of incidence with the reflector 302, as described for exemplary ray 320 in FIG. 3A, and thus depend on the position of the LED.

Furthermore, the LED bulb 300 includes multiple LEDs 304 that contribute light to the output of the bulb. The light emitted from all the LEDs 304 over all directions combines to produce an output beam having a light-distribution profile such as that shown in FIG. 1A. Similar to the output angle of the single rays 320 and 321 described above, the light-distribution profile produced by the combination of all the light emitted from all of the LEDs 304 is adjusted as the adjustment mechanism moves the LEDs 304 along the longitudinal axis of the LED bulb 300 relative to the reflector 302.

FIGS. 4A through 5B illustrate an example of how the light-distribution profile of the output beam of an LED bulb according to the present disclosure may change as the position of the LEDs within the recess of the concave reflector is adjusted.

Figure 4A:
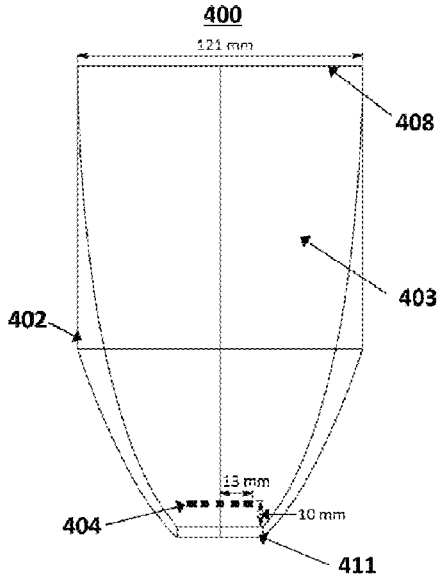
FIG. 4A depicts a parabolic aluminized reflector (PAR) and an array of LEDs in a first position.

FIG. 4A depicts an LED bulb 400 including a parabolic aluminized reflector (PAR) 402 having a 121 millimeter aperture 408. The parabolic reflector 402 may also be referred to as a paraboloid or a paraboloidal reflector. A single row of LEDs 404 is arranged in a circular array facing radially away from the longitudinal axis of the reflector 402. As configured in FIG. 4A, the LEDs 404 are 10 mm from the base 411 of the reflector 402 and are 13 mm radially away from the longitudinal axis. LED bulb 400 may also include a thermally conductive liquid 403 to transfer heat from the LEDs 404 to the reflector 402.

Figure 4B:
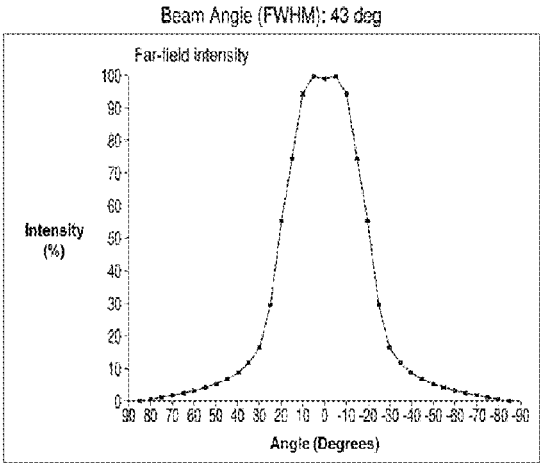
FIG. 4B depicts an intensity pattern of the light output from a PAR when LEDs are in a first position.

FIG. 4B depicts the normalized far-field intensity of a cross-section of a beam produced by the LED bulb 400 depicted in FIG. 4A. Specifically, FIG. 4B depicts the normalized far-field intensity of the output beam of the LED bulb 400 as a function of the angle from the longitudinal axis of the bulb. Notably, the far-field intensity of the beam is half of its maximum value at an angle of approximately 21.5 degrees. Thus, in this example, the beam angle at FWHM is approximately 43 degrees.

Figure 5A:
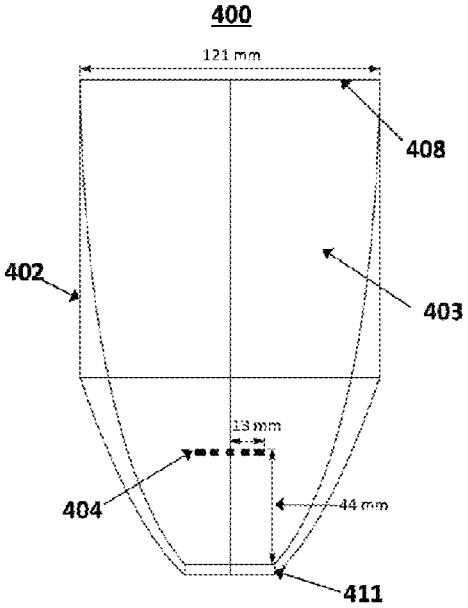
FIG. 5A depicts a parabolic aluminized reflector and an array of LEDs in a second position.
Figure 5B:
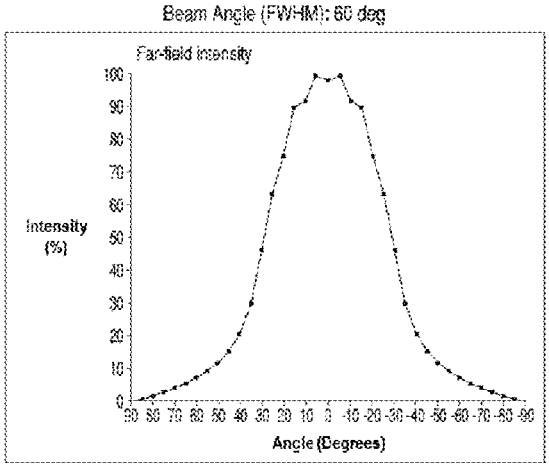
FIG. 5B depicts a far-field intensity pattern of the light output from the PAR when LEDs are in a second position.

FIG. 5A also depicts the LED bulb 400 with the LEDs 404 in a different position relative to the LED bulb 400 depicted in FIG. 4A. Compared to the configuration depicted in FIG. 4A, the LEDs 404 are moved toward the aperture 408 of the reflector 402 (i.e., away from the base 411) along the longitudinal axis. As shown in FIG. 5A, the LEDs are 44 mm from the base of the reflector 402. FIG. 5B depicts the normalized far-field intensity of a cross-section of the output beam produced when the LEDs 404 are positioned as depicted in FIG. 5A. In FIG. 5B, the beam angle, measured by the FWHM, is approximately 60 degrees. As such, the beam angle is adjusted as the LEDs 404 are moved along the longitudinal axis. In this example, the width of the beam of the LED bulb 400 is increased by moving the LEDs 404 toward the aperture 408 of the reflector.

Turning now to FIGS. 6A-7B, alternative embodiments of the adjustment mechanism used to move the LEDs relative to the reflector are described. It should be appreciated that there are various ways in which a mount, reflector, and adjustment mechanism may be configured to move LEDs relative to the reflector.

Figure 6A:
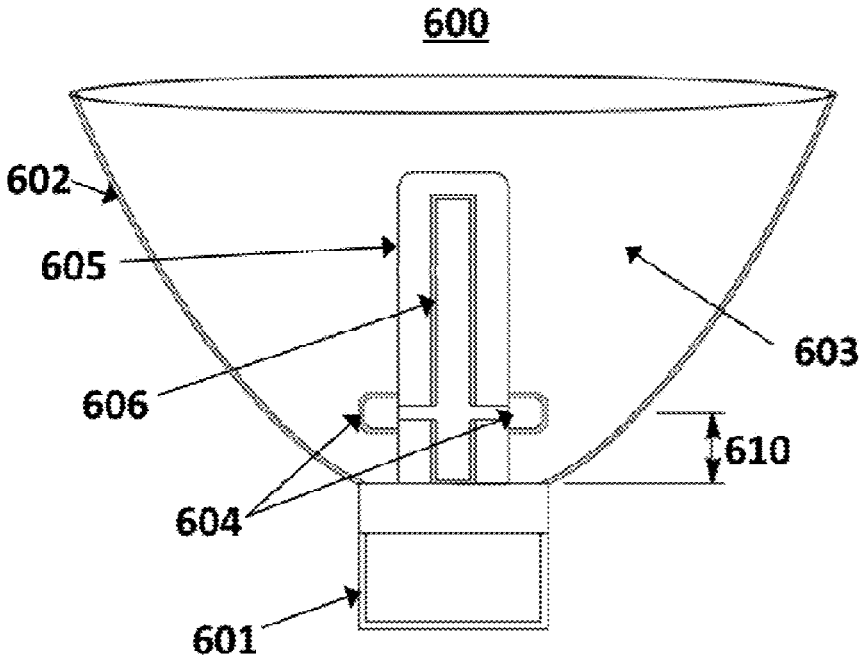
FIG. 6A depicts a cross-sectional view of an exemplary LED bulb having LEDs located in a first position.
Figure 6B:
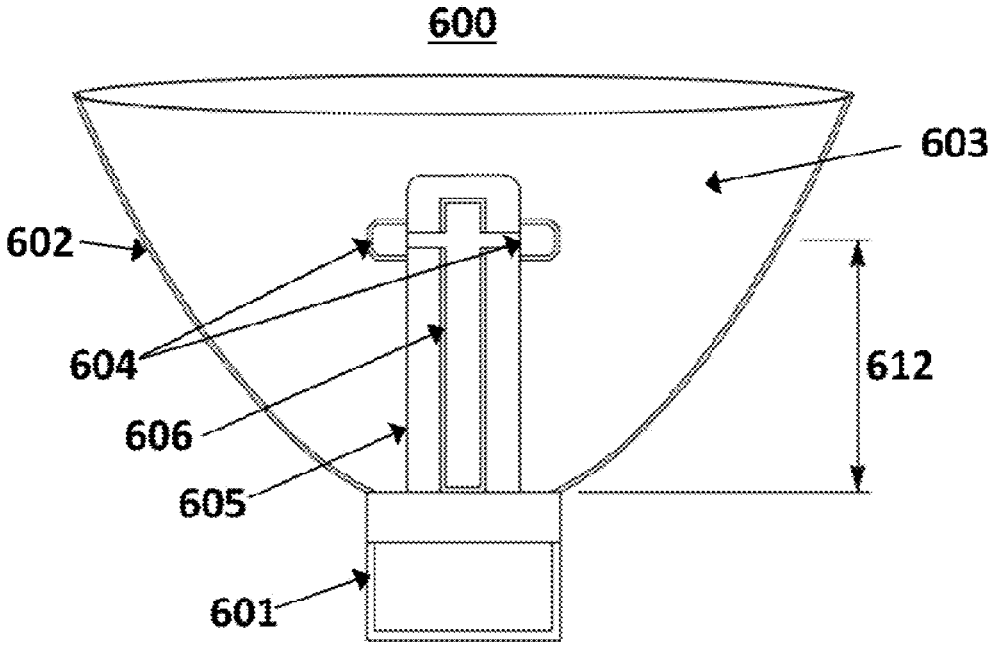
FIG. 6B depicts a cross-sectional view of an exemplary LED bulb having LEDs located in a second position.

For example, FIGS. 6A and 6B depict another embodiment of an LED bulb. In LED bulb 600, the adjustment mechanism 606 is configured to alter the position of the LEDs 604 by sliding the LEDs 604 along the surface of the mount 605. In FIG. 6A, the LEDs 604 are located at a first position a distance 610 from the end of the reflector 602. In FIG. 6B, the LEDs 604 are located at a second position a distance 612 from the end of the reflector 602. The LEDs 604 may be moved from the first position to the second position via the adjustment mechanism 606. The reflector 602 in FIGS. 6A and 6B remains fixed relative to the base 601 while the adjustment mechanism 606 moves the LEDs 604 relative to the reflector 602, thereby altering the light-distribution profile output by the LED bulb 600. In this example, the adjustment mechanism 606 provides continuous adjustment of the position of the LEDs 604 between the first and second positions. That is, the LEDs 604 may assume any position between a maximum and minimum distance from the base 601 along the longitudinal axis of the LED bulb 600. The adjustment mechanism may also allow adjustment of the position of the LEDs only in fixed increments. In some embodiments, LEDs may be moved between two or more discrete locations along the longitudinal axis of an LED bulb. Also, similar to the other embodiments described above, LED bulb 600 may include a thermally conductive liquid 603 to transfer heat from the LEDs 604 to the reflector 602.

Figure 7A:
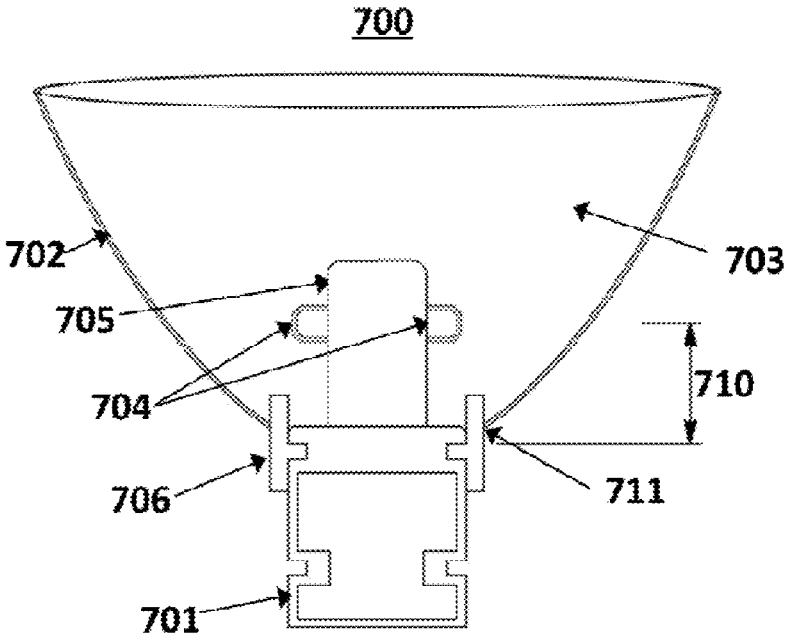
FIG. 7A depicts a cross-sectional view of an exemplary LED bulb having a reflector in a first position.
Figure 7B:
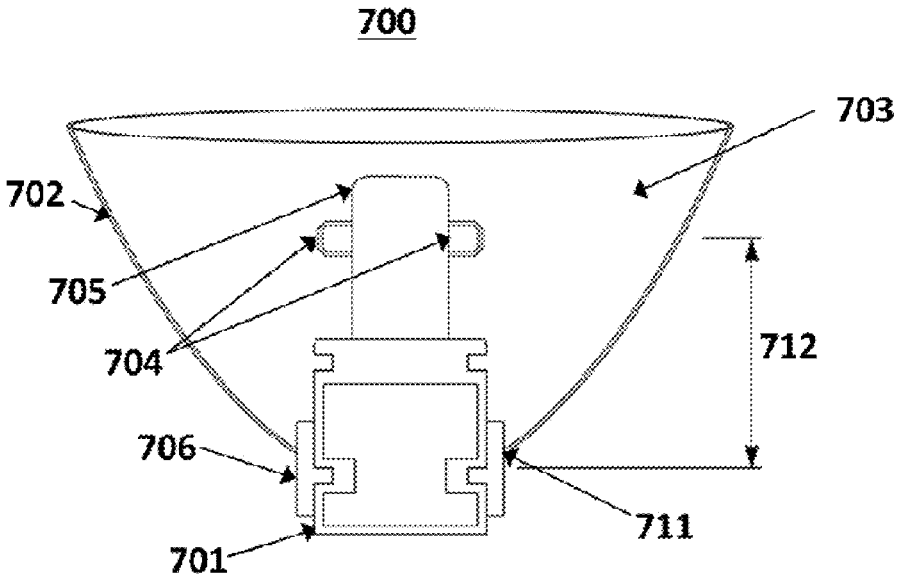
FIG. 7B depicts a cross-sectional view of an exemplary LED bulb having a reflector in a second position.

FIGS. 7A and 7B depict yet another embodiment of an LED bulb. In LED bulb 700, the adjustment mechanism 706 is configured to alter the height of the LEDs 704 relative to the reflector 702 by sliding the reflector 702 along the longitudinal axis of the LED bulb 700. In FIG. 7A, the LEDs 704 are located at a first position a distance 710 from the edge 711 of the reflector 702. In FIG. 7B, the LEDs 704 are located at a second position a distance 712 from the edge 711 of the reflector 702. The position of the LEDs 704 relative to the reflector 702 may be adjusted from the first position to the second position by moving the reflector 702 along the base 701 of the LED bulb 700, while keeping the LEDs 704 fixed relative to the base 701. In FIG. 7A, the reflector 702 is connected to an adjustment mechanism 706 that is configured to translate the reflector 702 along the longitudinal axis of the LED bulb 700 so that the aperture moves toward the base, resulting in the position of the reflector 702 depicted in FIG. 7B. Accordingly, the position of the LEDs 704 relative to the reflector 702 is changed, which alters the light-distribution profile output from the LED bulb 700. The adjustment mechanism 706 depicted in FIGS. 7A and 7B allows only two discrete positions of the reflector 702. In some embodiments, the reflector 702 may be moved between more than two discrete locations along the longitudinal axis of the LED bulb 700. In some embodiments, an adjustment mechanism may also provide continuous adjustment of the reflector 702 between the first and second positions. Furthermore, LED bulb 700 may also include a thermally conductive liquid 703 to transfer heat from the LEDs 704 to the reflector 702.

In the embodiments discussed above, the LEDs move relative to the reflector along the longitudinal axis of the reflector. In alternative embodiments, however, an adjustment mechanism may be configured to move the LEDs in a direction perpendicular to the longitudinal axis of the reflector. For example, the adjustment mechanism may move the LEDs radially toward or away from the longitudinal axis. Similar to moving the LEDs along the longitudinal axis of the bulb, moving the LEDs in a radial direction will also adjust the light-distribution profile of the output beam. Altering the radial position of the LEDs changes the angle of incidence at which portions of the light generated by the LEDs strike the inner surface of the reflector, thus resulting in a different output.

Figure 8A:
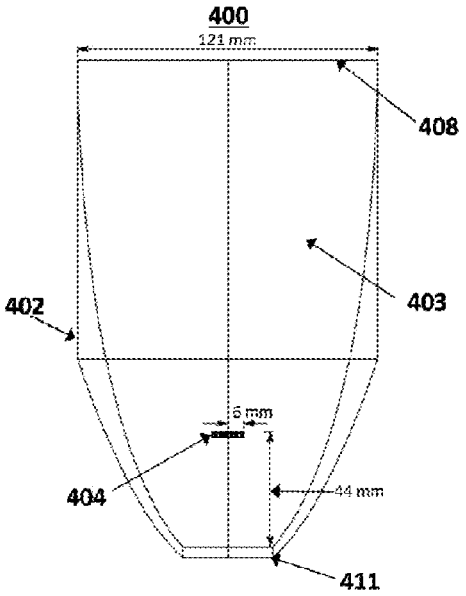
FIG. 8A depicts a parabolic aluminized reflector and an array of LEDs in a third position.
Figure 8B:
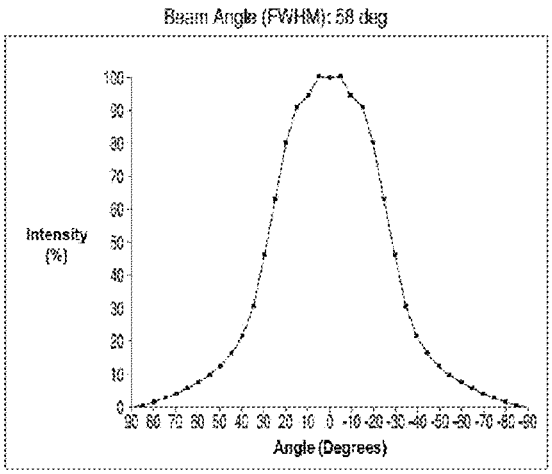
FIG. 8B depicts a far field intensity pattern of the light output from the PAR when LEDs are in a third position.

FIG. 8A depicts the LED bulb 400 depicted in FIGS. 4A and 5A with the LEDs 404 in a different position. Compared to the configurations depicted in FIGS. 4A and 5A, the LEDs 404 in FIG. 8A are positioned closer to the longitudinal axis of the bulb. As shown in FIG. 8A, the LEDs 404 are positioned 44 mm from the end of the reflector 402 and a radial distance of 6 mm from the longitudinal axis. FIG. 8B illustrates the normalized far-field intensity of a cross-section of the output beam produced when the LEDs 404 are positioned as depicted in FIG. 8A. In FIG. 8B, the beam angle measured by the FWHM is approximately 58 degrees, compared to the beam angle of 60 degrees for the configuration shown in FIG. 5A. Thus, in this example, the width of the beam is decreased by moving the LEDs 404 toward the longitudinal axis of the reflector 402 while maintaining the same position along the longitudinal axis of the reflector 402. Accordingly, moving an adjustable mount to change the radial position of the LEDs 404 adjusts the light-distribution profile and produces a different beam angle.

Figure 9A:
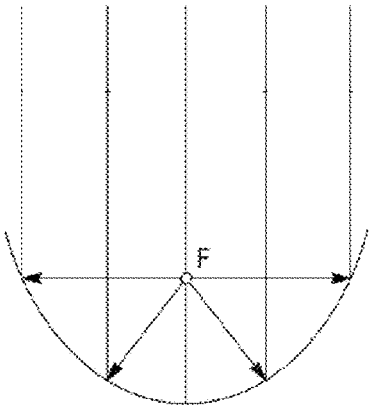
FIG. 9A depicts the reflection of rays originating from the focus of a PAR.

In the embodiments discussed above, the LEDs are positioned away from the longitudinal axis of the reflector. In some configurations, it may be desirable to have the LEDs positioned on the longitudinal axis of the reflector so that the LEDs may be closer to the focus of the reflector. FIG. 9A depicts the reflection of rays originating from the focus of a parabolic reflector. As shown in FIG. 9A, all rays emanating from the focus point F are reflected in a direction parallel to the longitudinal axis of the reflector. This may be desirable, as it produces a collimated beam having the narrowest possible far-field beam angle. In contrast, rays emanating from a point other than the focus are not uniformly reflected parallel to the longitudinal axis, resulting in a larger beam angle.

Accordingly, when the LEDs are not located at the focus of the reflector, the light generated by the LEDs may not be reflected completely parallel to the longitudinal axis when a parabolic reflector is used. Therefore, it may be desirable to have the LEDs positioned closer to the focus of the parabolic reflector so that light generated by the LEDs is reflected approximately parallel to the axis.

Figure 9B:
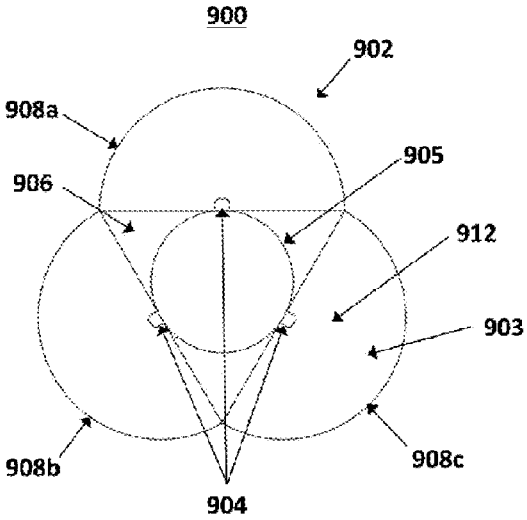
FIG. 9B depicts a top view of an LED bulb with a multiple reflector arrangement.

FIG. 9B depicts a top view of an LED bulb 900 with a multi-section reflector 902 configured to position LEDs 904 near the focus of a parabolic reflector. The multi-section reflector 902 includes a bottom surface 906 and portions of three parabolic reflectors 908*a*, 908*b*, and 908*c* (i.e., sub-reflectors). As shown in FIG. 9B, each of the sub-reflectors is half of a parabolic reflector divided vertically along its longitudinal axis. An adjustable mount 905 is located within the recess 912 of reflector 902 and aligned along the longitudinal axis of the reflector 902. The parabolic sections 908*a-c* surround the mount 905. The LEDs 904 are positioned on the sides of the mount 905 facing radially outward from the center of the reflector 902. The parabolic sections are positioned such that the optical axis of each of the parabolic sections is radially offset from the center of the mount 905 (which is co-axial with the longitudinal axis of the reflector 902) and is oriented parallel to the longitudinal axis of the reflector 902. The geometry of the LED bulb 900 is configured such that the LEDs 904 are proximate to the optical axes of the respective parabolic sections.

The LED bulb 900 may include an adjustment mechanism, such as that described above, for example, that is configured to adjust the position of the LEDs 904 relative to the sub-reflectors. For example, the adjustment mechanism may move the LEDs 904 from a first position to a second position, relative to the reflector. The LEDs produce a first light-distribution profile when in the first position and may produce a second light-distribution profile different from the first light-distribution profile when in the second position. The second light-distribution profile may have a different beam angle from the beam angle of the first light-distribution profile. In one position, each LED 904 may be located approximately at the focus of a respective parabolic section. When the LEDs are at the focus of a parabolic reflector, light generated by the LEDs is reflected substantially parallel to the longitudinal axis of the bulb. This may produce a substantially collimated beam having a light-distribution profile with the narrowest beam angle possible for the given reflector.

The LED bulb 900 may also include a cover, such as a lens, forming an enclosed volume. A thermally conductive liquid 903 may be disposed within the reflector that is in thermal contact with the LEDs and an inner surface of the reflector 902. The thermally conductive liquid 903 may be configured to transfer heat generated by the LEDs 904 to the reflector 902. The reflector 902 may act as a thermal conduit to dissipate heat transferred by the thermally conductive liquid to the surrounding environment. The LED bulb 900 may also include a volume-compensation mechanism, such as a bladder or a diaphragm, to compensate for expansion of the thermally conductive liquid, as will be discussed in greater detail below.

The description thus far has focused on the light-distribution issues associated with LED bulbs. As mentioned above, however, LED bulbs also have thermal-management issues. Thermal management in a bulb having LEDs that are statically positioned within the bulb may be aided by conducting heat through a rigid support structure composed of a thermally conductive material. For example, LEDs may be mounted so that they are in thermal communication with a metal, such as copper or aluminum, which draws heat by conduction from the LEDs toward a base or cooling fins.

This method of thermal management, however, may not be sufficient for LED bulbs with an adjustment mechanism, such as those described above, as this method relies on having a large average cross-section of conductive material in thermal communication with the heat source (e.g., the LEDs). Designing an adjustment mechanism and/or mount with both the desired motion capability and ability to provide adequate thermal conduction may not be feasible. In some cases, an adjustment mechanism includes an interface that slides, translates, or rotates, which may impair or limit the thermal conduction between the moving parts, thus limiting the conduction of heat from the LEDs to the mount and/or base. Moreover, thermal conduction may be further limited in mount configurations in which there is a break between moving parts and/or a gap between the LEDs and the core of the mount.

A thermally conductive liquid may be held with an enclosed volume of the LED bulb to remove heat from the LEDs in the bulb. Using a liquid-filled bulb offers several distinct advantages over traditional air-filled bulbs. A bulb filled with a thermally conductive liquid provides improved heat dissipation from the LEDs, as compared to an air-filled bulb. As used herein, the term "liquid" refers to a substance capable of flowing. Also, the substance used as the thermally conductive liquid is a liquid or at the liquid state within, at least, the operating temperature range of the bulb. An exemplary temperature range includes temperatures between −40° C. to +50° C. The thermally conductive liquid may be any thermally conductive liquid, such as mineral oil, silicone oil, glycols (PAGs), fluorocarbons, or other material capable of flowing. It may be desirable to have the chosen liquid be a non-corrosive dielectric. Selecting such a liquid can reduce the likelihood that the liquid will cause electrical shorts, and reduce damage to the components of LED bulb.

Referring back to FIG. 2, LED bulb 200 is filled with thermally conductive liquid 203 for transferring heat generated by LEDs 204 to the reflector 202. The thermally conductive liquid 203 is in thermal contact with the reflector 202 and the plurality of LEDs 204, and transfers heat from the plurality of LEDs 204 to the reflector 202. Because the thermally conductive liquid 203 is in contact with the LEDs 204, heat may be conducted into the thermally conductive liquid 203 from the LEDs 204. Heat is transferred from the thermally conductive liquid 203 to the reflector 202, which functions as a thermal conduit to the surrounding environment (e.g., a heatsink). The reflector 202 is typically formed from a thermally conductive material to facilitate heat transfer from the thermally conductive liquid 203 and dissipation to the base 201 or the surrounding environment. In some cases, the exterior of the reflector 202 may have cooling fins to facilitate heat dissipation to the surrounding atmosphere. This thermal-management configuration allows LED bulbs to achieve higher power dissipation.

Additionally, active or passive convective currents may be formed within the thermally conductive liquid that improve dissipation by dispersing the heat throughout the thermally conductive liquid. For example, passive convective flow may circulate the thermally conductive liquid without the aid of a fan or other mechanical device driving the flow of the thermally conductive liquid. Passive convective currents may form within the thermally conductive liquid due to the heat differential between the LEDs and the relatively cooler reflector.

Figure 10:
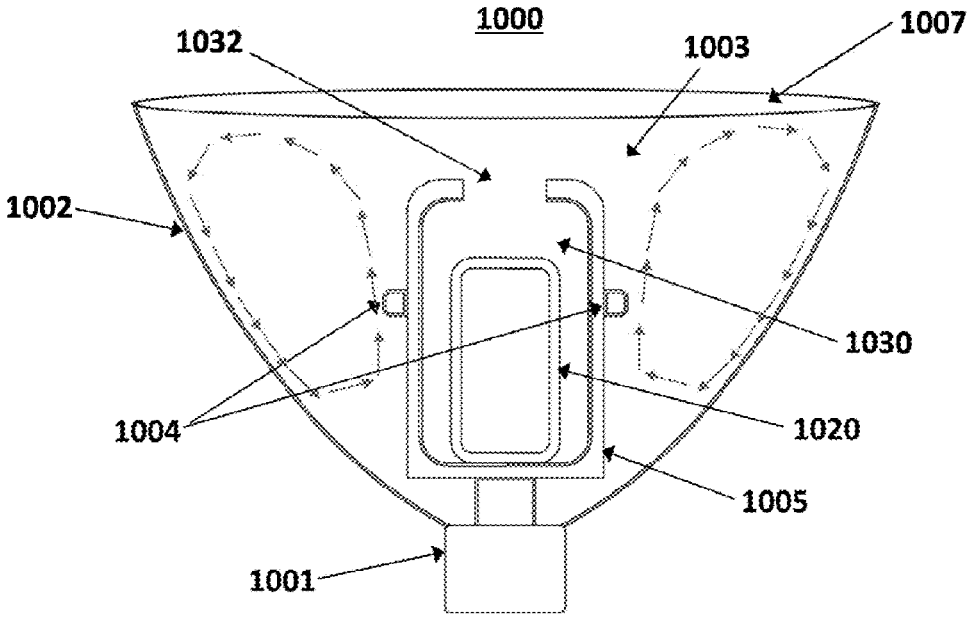
FIG. 10 depicts a cross-sectional view of an LED bulb with a bladder.

FIG. 10 depicts an LED bulb 1000 with a passive convective current according to one embodiment. As depicted by the arrows in FIG. 10, heat is transferred away from LEDs 1004 in LED bulb 1000 via passive convective flows. Cells of liquid surrounding LEDs 1004 absorb heat, become less dense due to the temperature increase, and rise upward. As the cells of liquid reach the cover 1007, they move outward toward the reflector 1002. As heat is transferred to the reflector 1002 and the cells of liquid cool down, they become denser and descend to the bottom, continuing to transfer heat to the reflector 1002 as they move along the inside surface of the reflector 1002. It may be desirable to configure structural features to facilitate the passive convective flow in the LED bulb. For example, in the embodiments described herein, a gap is provided between the LEDs and the reflector sufficient to allow the liquid to form passive convective currents. In addition, parts should be configured to not block the path of circulating liquid. In addition, it may be desirable to include structural features that facilitate the passive convective flow. For example, liquid displacers (not shown) may be included inside the enclosed volume to facilitate a flow of thermally conductive liquid. A liquid displacer may direct the flow to follow a cyclical path along the inner surface of the reflector, thus improving the heat dissipation of the LED bulb.

In some embodiments, the thermally conductive liquid and a reflector may provide the primary path for dissipating heat from the LEDs to the surrounding environment. In other embodiments, an LED bulb may include several other components for dissipating heat generated by the LEDs. For example, the mount, adjustment mechanism, base, or other component may also facilitate heat dissipation, and may be made of a thermally conductive material, such as aluminum, copper, brass, magnesium, zinc, or the like. In some embodiments, the mount, adjustment mechanism, or both are made of a composite laminate material. In such embodiments, heat generated by the LEDs may be conductively transferred to the mount and/or adjustment mechanism and passed to another component of the LED bulb to dissipate the heat to the surrounding environment.

In some embodiments, the bulb base may be made of a thermally conductive material. In such embodiments, the base may be in thermal contact with the mount, adjustment mechanism, reflector, thermally conductive liquid, or other component to dissipate heat to the surrounding environment.

It should be recognized that the components, techniques, and other features described above related to thermal management may be used for all the embodiments that are described herein, including, but not limited to, the specific embodiments depicted in the various figures.

Turning again to FIG. 10, LED bulb 1000 also includes a volume-compensation mechanism to allow for thermal expansion of the thermally conductive liquid contained in the LED bulb 1000. In the exemplary embodiment depicted in FIG. 10, the mechanism is a bladder 1020. The bladder 1020 is disposed in a cavity 1030 of the mount 1005. The cavity 1030 is in fluidic connection with the enclosed volume created between the reflector 1002, cover 1007, and base 1001. As shown in FIG. 10, a channel 1032 connects the enclosed volume and the cavity 1030, allowing the thermally conductive liquid 1003 to enter the cavity 1030. The outside surface of the bladder 1020 is in contact with the thermally conductive liquid 1003. The volume of the cavity that is not occupied by the bladder 1020 is typically filled with the thermally conductive liquid 1003. The bladder 1020 is capable of compression and/or expansion to compensate for expansion of the thermally conductive liquid 1003.

Figure 11:
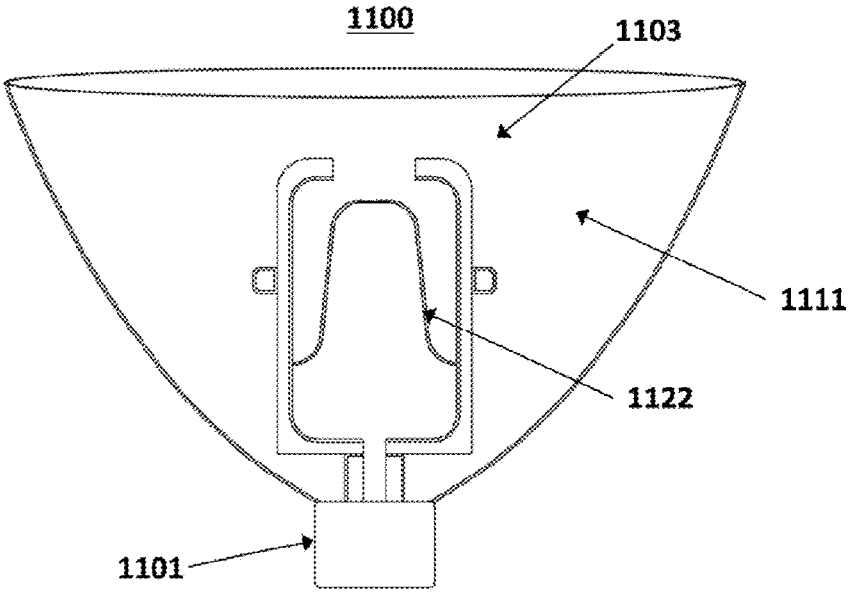
FIG. 11 depicts a cross-sectional view of an LED bulb with a diaphragm.

FIG. 11 depicts an alternative configuration using a diaphragm 1122 to compensate for thermal expansion of the thermally conductive liquid 1103. In this embodiment, one surface of the diaphragm 1122 is in fluidic connection with the thermally conductive liquid. The opposite surface is typically exposed to ambient pressure conditions (e.g., vented to the ambient air outside the bulb through the base 1101). The diaphragm 1122 is capable of deformation and/or movement to compensate for expansion of the thermally conductive liquid 1111.

Furthermore, it should be recognized that a volume-compensation mechanism such as the ones described above (e.g., a bladder or diaphragm) may be used for all the embodiments that are described herein, including, but not limited to, the specific embodiments depicted in the various figures.

It should also be appreciated that in addition to the embodiments and configurations discussed thus far, various combinations and alternative configurations of the LED bulb, and portions thereof, are possible.

For example, it should be appreciated that various configurations of the mount and adjustment mechanism are possible. The mount may be a single piece or may comprise multiple pieces. In a mount having multiple pieces, some pieces may be configured to move relative to others. For example, the mount may have a central post aligned parallel to the longitudinal axis of the bulb, and a ring that is configured to support the LEDs and slide along the length of the post. In some embodiments, the mount may be a component distinct from the adjustment mechanism. In other embodiments, the mount and adjustment mechanism may be integrated into a single component.

The adjustment mechanism may be any means capable of changing the position and/or configuration of the mount and/or the reflector such that the position of the LEDs relative to the reflector is changed. The adjustment mechanism may translate the mount, or a portion thereof, along the longitudinal axis of the bulb. For example, the adjustment mechanism may cause at least a portion of the mount to slide parallel to the longitudinal axis of the bulb. The adjustment mechanism may additionally or alternatively translate the reflector, or a portion thereof, along the longitudinal axis of the bulb. Furthermore, the adjustment mechanism may additionally or alternatively change the radius of the mount, or a portion thereof. To move the mount or the reflector, the adjustment mechanism may use, for example, mechanical, hydraulic, pneumatic, or electrical means, or some combination thereof. The adjustment mechanism may be actuated in various ways. For example, there may be a control mechanism such as a switch, knob, button, lever, or the like coupled to the adjustment mechanism that is configured to cause the adjustment mechanism to change the location of the LEDs relative to the reflector. The adjustment mechanism may be automatically controlled or activated manually.

It should also be appreciated that the present disclosure may be applied to LED bulbs with reflectors having various shapes. In some embodiments, the reflector may have a parabolic shape such as that in the PARs described above. Various configurations of parabolic reflectors may be possible, including reflectors with different aperture sizes (e.g., PAR14, PAR16, PAR20, PAR30, PAR36, and PAR38) and different curvatures, for example. Other reflector shapes may also be possible, including, for example, a bulged reflector (BR-shaped), ellipsoidal reflector (ER-shaped), blown reflector (R-shaped), multifaceted reflector (e.g., MR16), or the like.

Various types of materials may be used for the reflective inner surface of the reflector. For example, the reflector may be made from a reflective metal including aluminum, silver, or the like. The reflector, or portions thereof, may have a smooth surface (relative to the wavelength of light emitted from the LEDs) so as to produce specular reflection. Alternatively, the reflector, or portions thereof, may have a rough surface so as to produce diffuse reflection. Due to the directional nature of LEDs, a specular reflector may produce a light-distribution profile with distinct peaks, or give the appearance of point sources. A diffuse reflector may be used to disperse light produced by the LEDs and smooth out the profile.

Various types of covers may also be used. For example, the cover may be made from any transparent or translucent material, such as plastic, glass, polycarbonate, or the like. The cover may be clear or frosted. Similar to a diffuse reflector, a frosted cover may disperse light exiting the aperture to smooth out distinct peaks in the light-distribution profile, and/or reduce the appearance of point sources. The cover may also act as a lens to further alter the profile of the light output from the bulb. The lens may be static or adjustable. The cover may also comprise on one of its surfaces, within its body, or both, a material to scatter, disperse, reflect, refract, and/or alter the wavelength of light emitted from the LEDs, including, for example, a phosphor or a dispersion agent. In some cases, the cover may be coated on the inside or outside with a material that produces increased diffusion. For example, the shell may be coated with a chemical-based or water-based paint that produces increased diffusion. In an alternative embodiment, the shell may be etched using a chemical treatment to produce increased diffusion.

It should also be appreciated that various types of bases or connectors may be used. An LED bulb may include a base for connecting the bulb to a lighting fixture. In one example, the base may be a conventional light bulb base having threads for insertion into a conventional light socket. However, it should be appreciated that the base may be any type of connector for mounting an LED bulb or coupling to a power source. For example, the base may provide mounting via a screw-in base, a dual-prong connector, a standard two- or three-prong wall outlet plug, bayonet base, Edison-screw base, single-pin base, multiple-pin base, recessed base, flanged base, grooved base, side base, or the like. Components of the base may include, for example, sealing gaskets, flanges, rings, adaptors, or the like. The base can also include one or more die-cast or spun-aluminum parts.

Although a feature may appear to be described in connection with a particular embodiment, one skilled in the art would recognize that various features of the described embodiments may be combined. Moreover, aspects described in connection with an embodiment may stand alone.

We claim:

1. A light-emitting diode (LED) bulb comprising:

a reflector having a recess and a reflective inner surface;

a plurality of LEDs disposed within the recess of the reflector;

a thermally conductive liquid within the recess of the reflector and in thermal contact with the LEDs and the inner surface of the reflector; and an adjustment mechanism configured to adjust the position of the plurality of LEDs relative to the reflector from a first position to a second position, wherein light generated by the plurality of LEDs produces a first light-distribution profile when the LEDs are in the first position, and produces a second light-distribution profile when the LEDs are in the second position.

2. The LED bulb of claim 1, wherein the thermally conductive liquid transfers heat generated by the LEDs to the reflector, and the reflector dissipates the heat transferred by the thermally conductive liquid to the surrounding environment.

3. The LED bulb of claim 1, wherein the first light-distribution profile is characterized by a first beam angle, and the second light-distribution profile is characterized by a second beam angle that is different from the first beam angle.

4. The LED bulb of claim 3, wherein the LEDs are closer to a base of the recess in the first position than in the second position, and the second beam angle is greater than the first beam angle.

5. The LED bulb of claim 1, wherein:

the reflector has a longitudinal axis; and the adjustment mechanism is configured to move the LEDs parallel to the longitudinal axis of the reflector.

6. The LED bulb of claim 1, wherein:

the reflector has a longitudinal axis; and the adjustment mechanism is configured to move the LEDs in a radial direction relative to the longitudinal axis of the reflector.

7. The LED bulb of claim 1, wherein:

the reflector has a longitudinal axis; and the adjustment mechanism is configured to move the reflector parallel to the longitudinal axis of the reflector.

8. The LED bulb of claim 1, wherein:

the reflector has a longitudinal axis; and the LEDs face radially outward from the longitudinal axis of the reflector.

9. The LED bulb of claim 1, wherein the reflector is a paraboloid.

10. The LED bulb of claim 1, wherein the reflector is a diffused reflector.

11. The LED bulb of claim 1, further comprising a frosted lens.

12. The LED bulb of claim 1, wherein the LEDs are arranged in a radial pattern.

13. The LED bulb of claim 1, further comprising a volume-compensation mechanism, the volume-compensation mechanism configured to compensate for expansion of the thermally conductive liquid.

14. The LED bulb of claim 13, wherein the volume-compensation mechanism is a bladder.

15. The LED bulb of claim 13, wherein the volume-compensation mechanism is a diaphragm.

16. A light-emitting diode (LED) bulb comprising:

a reflector having a recess, an inner surface, and a longitudinal axis, the reflector comprising a plurality of sub-reflectors arranged around the longitudinal axis, each of the sub-reflectors having an optical axis substantially parallel to and offset from the longitudinal axis of the reflector;

a plurality of LEDs disposed within the recess of the reflector, wherein each of the LEDs is located proximate to an optical axis of one of the sub-reflectors;

a thermally conductive liquid within the recess of the reflector and in thermal contact with the LEDs and the inner surface of the reflector; and an adjustment mechanism configured to adjust the position of the plurality of LEDs relative to the reflector from a first position to a second position, wherein light generated by the plurality of LEDs produces a first light-distribution profile when the LEDs are in the first position, and produces a second light-distribution profile when the LEDs are in the second position.

17. The LED bulb of claim 16, wherein the thermally conductive liquid transfers heat generated by the LEDs to the reflector, and the reflector dissipates the heat transferred by the thermally conductive liquid to the surrounding environment.

18. The LED bulb of claim 16, wherein each of the sub-reflectors is a portion of a parabolic reflector.

19. The LED bulb of claim 16, wherein the first light-distribution profile is characterized by a first beam angle and the second light-distribution profile is characterized by a second beam angle different from the first beam angle.

20. The LED bulb of claim 19, wherein the LEDs are closer to a base of the recess in the first position than in the second position, and the second beam angle is greater than the first beam angle.

21. The LED bulb of claim 16, wherein:

the adjustment mechanism is configured to move the LEDs parallel to the longitudinal axis of the reflector.

22. The LED bulb of claim 16, wherein:

the adjustment mechanism is configured to move the reflector parallel to the longitudinal axis of the reflector.

23. The LED bulb of claim 16, wherein at least one of the sub-reflectors is a diffused reflector.

24. The LED bulb of claim 16, further comprising a frosted lens covering.

25. The LED bulb of claim 16, further comprising a volume-compensation mechanism, wherein the volume-compensation mechanism is configured to compensate for expansion of the thermally conductive liquid.

26. The LED bulb of claim 25, wherein the volume-compensation mechanism is a bladder.

27. The LED bulb of claim 25, wherein the volume-compensation mechanism is a diaphragm.

* * * * *